US007475441B1

(12) United States Patent
Soberal

(10) Patent No.: US 7,475,441 B1
(45) Date of Patent: Jan. 13, 2009

(54) BABY COMFORTING APPARATUS

(76) Inventor: Omar Soberal, 53 Larkin St., Staten Island, NY (US) 10302

( * ) Notice: Subject to any disclaimer, the term of this patent is extended or adjusted under 35 U.S.C. 154(b) by 0 days.

(21) Appl. No.: 11/697,996

(22) Filed: Apr. 9, 2007

(51) Int. Cl.
*A47D 7/01* (2006.01)
*A47D 13/08* (2006.01)
*A47C 20/04* (2006.01)

(52) U.S. Cl. ..... 5/655; 5/634; 5/904

(58) Field of Classification Search ..... 5/655, 5/657, 652, 632–634, 639, 640, 660, 108, 5/109, 904, 915
See application file for complete search history.

(56) References Cited

U.S. PATENT DOCUMENTS 858,908 A * 7/1907 Rauch ..... 5/634
969,099 A * 8/1910 Fuchs ..... 5/634
1,060,655 A * 5/1913 Wood ..... 5/634
2,387,357 A * 10/1945 Rogerson ..... 5/660
2,611,363 A * 9/1952 Peters ..... 5/603
2,666,216 A * 1/1954 Schnaitter ..... 5/660
2,777,138 A * 1/1957 Gallagher ..... 5/655
2,918,682 A * 12/1959 Thoresen et al. ..... 5/660
3,392,723 A * 7/1968 Calvin ..... 601/5
3,423,773 A * 1/1969 Yamate ..... 5/610
3,931,653 A * 1/1976 Bien ..... 5/634
4,188,678 A * 2/1980 Rawolle ..... 5/105
4,228,793 A * 10/1980 Ramey ..... 601/57
4,458,370 A * 7/1984 Fickler ..... 5/660
4,471,767 A * 9/1984 Guimond ..... 601/5
4,625,348 A * 12/1986 Renggli et al. ..... 5/614
4,862,535 A * 9/1989 Roberts ..... 5/655
4,941,453 A * 7/1990 Shakas et al. ..... 600/28
5,014,376 A * 5/1991 Doran et al. ..... 5/603
5,063,912 A * 11/1991 Hughes ..... 601/47
5,127,422 A * 7/1992 Colon ..... 5/655
5,172,955 A * 12/1992 Freese et al. ..... 297/302.3
5,205,811 A * 4/1993 Fornarelli ..... 600/28
5,207,478 A * 5/1993 Freese et al. ..... 297/296
5,357,642 A * 10/1994 Clute ..... 5/655
5,425,150 A * 6/1995 Palmer et al. ..... 5/615
5,439,008 A * 8/1995 Bowman ..... 128/875
5,464,381 A 11/1995 Wilson
5,697,112 A * 12/1997 Colavito et al. ..... 5/633
5,700,059 A * 12/1997 Moscot ..... 297/452.17
5,800,368 A * 9/1998 Klingemann et al. ..... 602/1
6,004,259 A 12/1999 Sedaros
6,142,963 A * 11/2000 Black et al. ..... 601/57
6,170,602 B1 * 1/2001 Mann ..... 181/141
6,292,964 B1 * 9/2001 Rose et al. ..... 5/630
6,594,840 B2 * 7/2003 Tomas et al. ..... 5/655
6,898,812 B2 * 5/2005 Smart ..... 5/655

(Continued)

FOREIGN PATENT DOCUMENTS

EP 92784 A2 * 11/1983

*Primary Examiner*—Robert G Santos
(74) *Attorney, Agent, or Firm*—Crossley Patent Law; Mark A. Crossley

(57) ABSTRACT

The baby comforting apparatus provides recording of both an actual mother's heartbeat and the mother's breathing. The apparatus also provides for the simulated rise and fall of a mother's chest while breathing. The infant is placed upon the apparatus in order to mimic the mother's breathing movements. These combined features provide comforting of an infant heretofore not provided. The pliable cover is provided in a variety of materials and colors, with the added benefit of relatively large flat surfaces which are ideal for logo placement.

9 Claims, 3 Drawing Sheets

U.S. PATENT DOCUMENTS

| | | | | |
|---|---|---|---|---|
| 6,931,683 | B1 * | 8/2005 | Elkin et al. | 5/655 |
| 6,968,806 | B2 * | 11/2005 | Helwig | 119/28.5 |
| 7,003,831 | B1 * | 2/2006 | Goutevenier-Reyher | 5/655 |
| 7,107,639 | B2 * | 9/2006 | Taricani | 5/655 |
| 7,251,846 | B1 * | 8/2007 | Elkin et al. | 5/655 |
| 7,412,737 | B2 * | 8/2008 | Hernadez | 5/655 |
| 2004/0068158 | A1 | 4/2004 | Bennett | |
| 2005/0028286 | A1 * | 2/2005 | Smart | 5/655 |
| 2005/0198739 | A1 * | 9/2005 | Elkin et al. | 5/655 |
| 2007/0074348 | A1 * | 4/2007 | Carlton | 5/639 |
| 2007/0079444 | A1 * | 4/2007 | Ward | 5/655 |
| 2007/0199149 | A1 * | 8/2007 | Elkin et al. | 5/655 |
| 2008/0066236 | A1 * | 3/2008 | Hernadez | 5/655 |
| 2008/0172794 | A1 * | 7/2008 | Lord | 5/655 |
| 2008/0172795 | A1 * | 7/2008 | Straub | 5/655 |
| 2008/0178387 | A1 * | 7/2008 | Kachtick-Anders | 5/603 |

* cited by examiner

BABY COMFORTING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

It is established that the sounds of a mother's heartbeat is comforting to an infant. However, a mother cannot always be present to provide that comfort. Mimicking the mother's heartbeat sounds has therefore become popularly accepted. Falsely reproduced heartbeat sounds, though, have not proven as effective as the mother's true heartbeat. A true recording of mother's heartbeat is therefore superior to falsely generated sounds. Additionally, reproduction of a mother's breathing sounds can be equally comforting. Again, false reproductions are not as effective in calming an infant as are true recordings of the specific infant mother. Further, various movements are also proven to comfort a baby. Among such proven movements are vibration and rocking motions. These movements, though, cannot provide comfort identical to that provided by the likeness of rise and fall of a caregiver's breathing chest. The present apparatus provides true recorded playback of a specific mother's heartbeat and breathing, at the same time providing the simulated rise and fall of a mother's chest.

FIELD OF THE INVENTION

The baby comforting apparatus relates to devices for soothing an infant and more especially to an apparatus that plays back a mother's recorded breathing and heartbeat while simultaneously mimicking the rise and fall of a mother's chest.

DESCRIPTION OF THE PRIOR ART

Prior related art does not provide the advantages of the present apparatus. As example, U.S. Pat. No. 6,004,259 issued to Sedaros 1999-12-21 teaches a baby calmer kit using mother's heartbeat sound. A kit provides for recording the mother's heartbeat, then playing the heartbeat back to the infant, triggered by crying. The kit does not provide for recording and playback of a mother's breathing. The kit does not provide for a device upon which the rise and fall of a mother's chest is simulated. U.S. Pat. No. 5,464,381 issued to Wilson 1995-11-07 teaches an infant soothing seat which simulates vibrations that occur in an automobile. U.S. Pat. App. Pub. No. 2004/0068158A1 issued to Bennett 2004-04-08 teaches a sound and heartbeat playback system. The system does not reproduce a mother's heartbeat.

While the above-described devices fulfill their respective and particular objects and requirements, they do not describe a baby comforting apparatus that provides for the advantages of the baby comforting apparatus. In this respect, the baby comforting apparatus substantially departs from the conventional concepts and designs of the prior art. Therefore, a need exists for an improved baby comforting apparatus.

SUMMARY OF THE INVENTION

The general purpose of the baby comforting apparatus, described subsequently in greater detail, is to provide a baby comforting apparatus which has many novel features that result in an improved baby comforting apparatus which is not anticipated, rendered obvious, suggested, or even implied by prior art, either alone or in combination thereof.

To attain this, the baby comforting apparatus provides recording of both an actual mother's heartbeat and the mother's breathing. The microphone within the record/playback device provides the sensitivity needed to record each accurately. The apparatus is placed next to a mother's chest to record both, with the switch in the record position. The apparatus also provides for the simulated rise and fall of a mother's chest while breathing. The infant is place upon the apparatus, with switch on, in order to mimic the mother's breathing movements. These combined features provide comforting on an infant heretofore not provided.

The apparatus is basic, lightweight and inexpensively produced and sold. The pliable cover is provided in a variety of materials and colors, with the added benefit of relatively large flat surfaces which are ideal for logo placement. An alternate embodiment of the apparatus provides for electrical plug-in to an outlet, as well as battery power backup.

Thus has been broadly outlined the more important features of the improved baby comforting apparatus so that the detailed description thereof that follows may be better understood and in order that the present contribution to the art may be better appreciated.

An object of the baby comforting apparatus is to accurately reproduce a specific mother's true heartbeat sound.

Another object of the baby comforting apparatus is to accurately reproduce a specific mother's breathing sounds.

A further object of the baby comforting apparatus is to mimic the rise and fall of a mother's chest while breathing.

An added object of the baby comforting apparatus is to provide a cushioned surface for a baby to lie on.

Still another object of the baby comforting apparatus is to provide a conforming surface for a baby to lie on.

Additionally, an object of the baby comforting apparatus is to provide for baby body heat retention.

Yet another object of the baby comforting apparatus is to be lightweight.

These together with additional objects, features and advantages of the improved baby comforting apparatus will be readily apparent to those of ordinary skill in the art upon reading the following detailed description of the presently preferred, but nonetheless illustrative, embodiments of the improved baby comforting apparatus when taken in conjunction with the accompanying drawings.

In this respect, before explaining the current embodiments of the improved baby comforting apparatus in detail, it is to be understood that the baby comforting apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved baby comforting apparatus. It is therefore important that the claims be regarded as including such equivalent constructions insofar as they do not depart from the spirit and scope of the baby comforting apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the baby comforting apparatus generally designated by the reference number 10 will be described.

Figure 1:
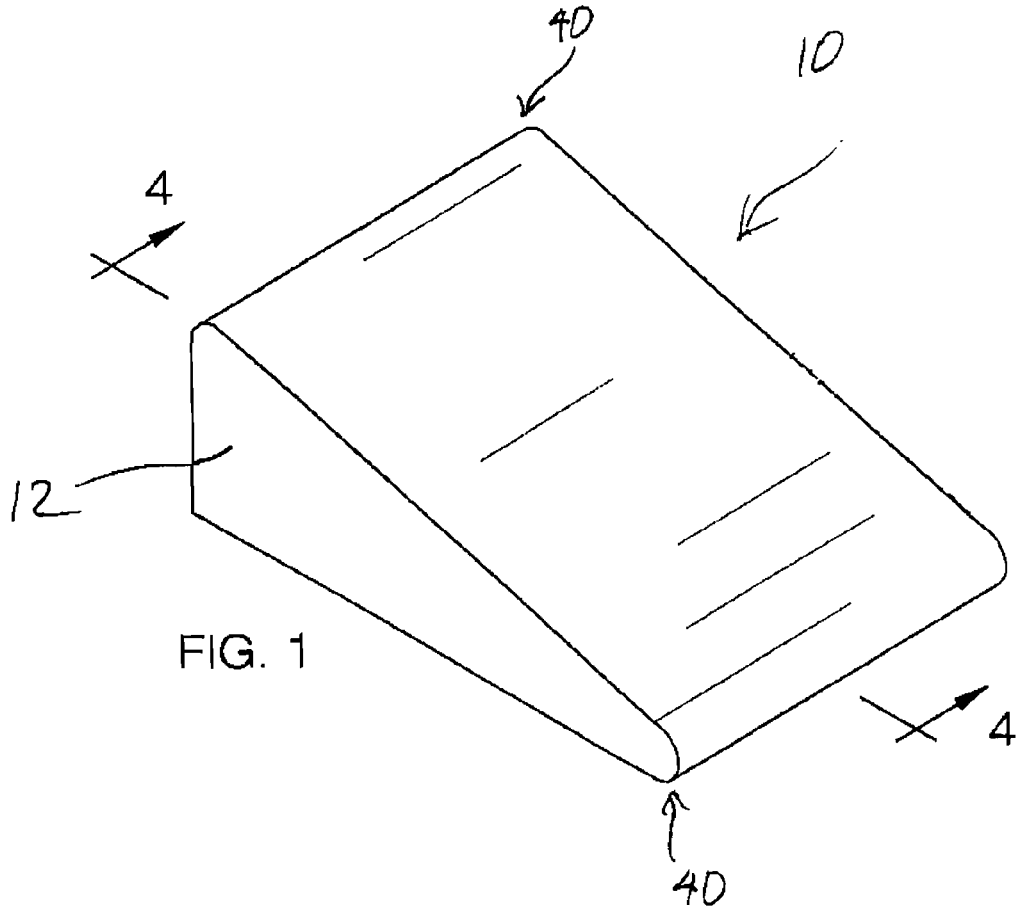
FIG. 1 is a perspective view.
Figure 2:
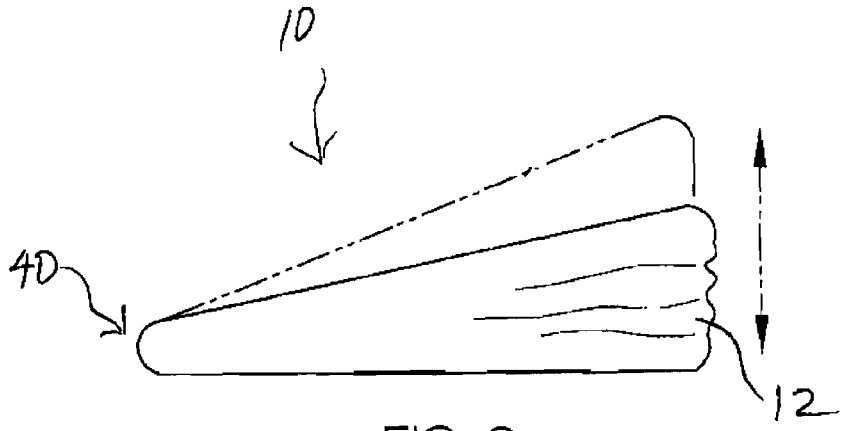
FIG. 2 is a lateral elevation view illustrating compression and extension capability of the apparatus.
Figure 3:
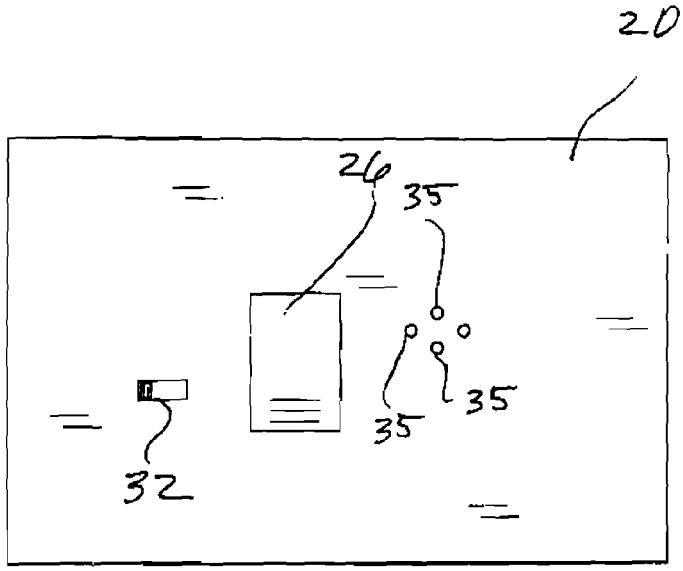
FIG. 3 is a bottom plan view.
Figure 4:
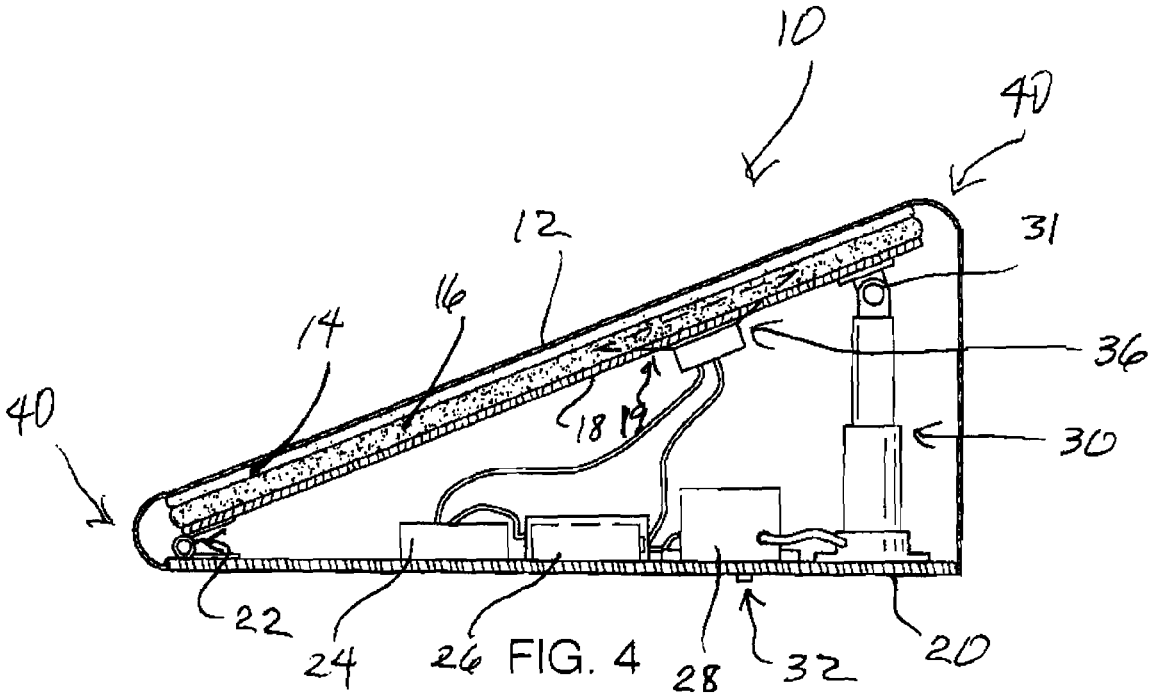
FIG. 4 is a cross sectional view of FIG. 1.
Figure 5:
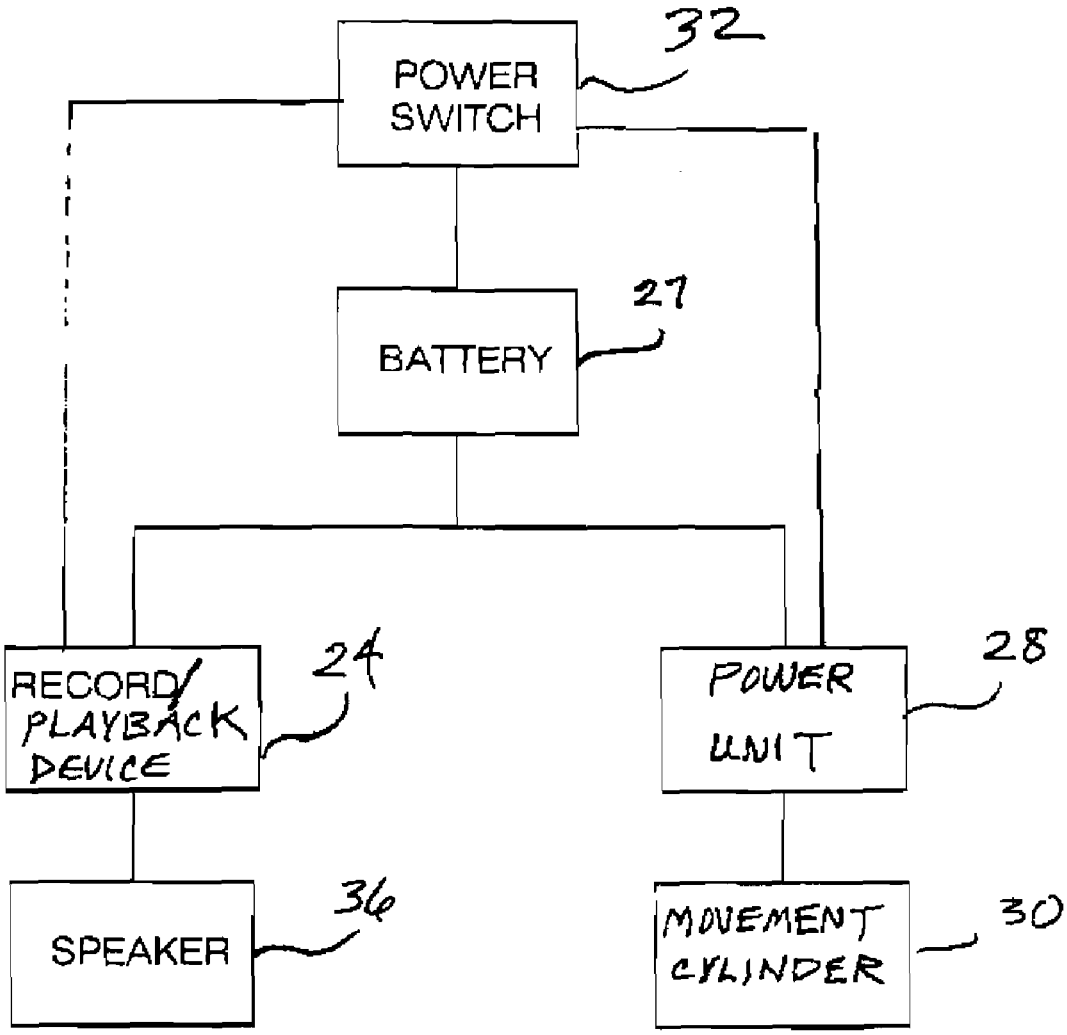
FIG. 5 is a schematic block diagram of communication of components within the apparatus.

Referring to FIGS. 1 and 2, the baby comforting apparatus 10 is provided for a baby to lie upon. The wedge-shaped apparatus 10 comprises a 5-sided polygon having a top, a bottom, two spaced apart sides, and an end. The rounded edges 40 provide for comfort and insure against an edge aggravating a baby. The apparatus 10 is for selective placement upon a supporting surface.

Referring to FIGS. 2-5, the pliable cover 12 provides for compression and extension of the platform 18 with the apparatus 10. The pliable cover 12 surrounds all but the bottom of the apparatus 10. The parallelepiped platform 18 comprises a part of the top of the apparatus 10. The platform 18 has a first end, a second end, two spaced apart sides, a top, and a bottom. The means for cushioning the top of the platform 18 comprises two layers. The layer of cushioning adjacent to the top of the platform 18 is a resilient cushion 16. The gel layer 14 is atop the cushion 16 and is comprised of a gel or gel-like material that is known in the art of human contact comforts. The gel layer 14 provides two advantages. First, the gel layer 14 provides for conformity to an infants shape, no matter the body position of the infant. Second, the gel layer 14 provides for improved body heat retention for the infant. The parallelepiped base 20 is disposed at the bottom of the apparatus 10. The base 20 has a first end, a second end, two spaced apart sides, a top, and a bottom. The orifices 35 are disposed in the bottom of the base 20 to allow audio access to the record/playback device 24. The hinge 22 connects the first end of the platform 18 to the first end of the base 20. The apparatus 10 further comprises the platform 18 movement cylinder 30 for moving the second end of the platform 18 relative to the base 20. The power unit 28 is in communication with the movement cylinder 30. The power unit 28 and movement cylinder 30 are provided in more than one embodiment. The first embodiment of the movement cylinder 30 and the power unit 28 comprises hydraulics. The power unit 28 pressurizes hydraulic flow to and from the cylinder 30 to cause the cylinder 30 to expand and contract in length, thereby rhythmically moving the platform 18 relative to the base 20. The subtle movement mimics a mother's chest in breathing. The second embodiment of the cylinder 30 and power unit 28 comprises pneumatics. The power unit 28 pumps air to the cylinder 30 rhythmically such that the cylinder expands and contracts in order to mimic a mother's chest in breathing. The sound record/playback device 24 provides for recording and playback of a mother's heartbeat and breathing. By providing an exact mother's recorded heartbeat and breathing, an infant is far more likely to be comforted as opposed to a heartbeat generated synthetically. The recording and playback of a mother's breathing provides like advantages. The record/playback device 24 is in communication with the speaker 36. One embodiment of the platform 18 provides a cutout 19 in the platform 18 for location of the acoustic speaker 36. The illustrated acoustic speaker 36 is preferred over other speaker forms due to realistic sound reproduction. The switch 32 is in communication with the power unit 28. The record/playback device 24 and the battery 27 in the battery compartment 26 are in communication with the switch 32. The multi-position switch 32 provides for recording, off, and on positions for the apparatus 10.

With respect to the above description then, it is to be realized that the optimum dimensional relationships for the parts of the baby comforting apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the baby comforting apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the baby comforting apparatus may be used.

Therefore, the foregoing is considered as illustrative only of the principles of the baby comforting apparatus. Further, since numerous modifications and changes will readily occur to those skilled in the art, it is not desired to limit the baby comforting apparatus to the exact construction and operation shown and described, and accordingly, all suitable modifications and equivalents may be resorted to, falling within the scope of the baby comforting apparatus.

What is claimed is:

1. A baby comforting apparatus for a baby to lie upon, the apparatus comprising:

a 5-sided polygon having a top, a bottom, two spaced apart sides, and an end;

a parallelepiped platform comprising a part of the top, the platform having a first end, a second end, two spaced apart sides, a top, and a bottom;

means for cushioning the top of the platform;

a parallelepiped base having a first end, a second end, two spaced apart sides, a top, and a bottom;

a hinge connecting the first end of the platform to the first end of the base;

platform movement means for moving the second end of the platform relative to the base;

powering means in communication with the platform movement means;

a switch in communication with the platform movement means, and the powering means;

a pliable cover surrounding all but the bottom of the apparatus, whereby the rise and fall of a mother's breathing chest is simulated, wherein the platform movement means for moving the second end of the platform relative to the base further comprises a movement cylinder connecting the second end of the platform to the second end of the base;

a power unit in communication with the movement cylinder.

2. The apparatus according to claim 1 wherein the movement cylinder and the power unit further comprise hydraulics.

3. The apparatus according to claim 1 wherein the movement cylinder and the power unit further comprise pneumatics.

4. A baby comforting apparatus for a baby to lie upon, the apparatus comprising:

a 5-sided polygon having a top, a bottom, two spaced apart sides, and an end;

a parallelepiped platform comprising a part of the top, the platform having a first end, a second end, two spaced apart sides, a top, and a bottom;

means for cushioning the top of the platform;

a parallelepiped base having a first end, a second end, two spaced apart sides, a top, and a bottom;

a hinge connecting the first end of the platform to the first end of the base;

platform movement means for moving the second end of the platform relative to the base;

powering means in communication with the platform movement means;

a switch in communication with the platform movement means, and the powering means;

a pliable cover surrounding all but the bottom of the apparatus, whereby the rise and fall of a mother's breathing chest is simulated, wherein the means for cushioning the top of the platform further comprises a cushion on the top of the platform, a gel layer atop the cushion, wherein the platform movement means for moving the second end of the platform relative to the base further comprises a movement cylinder connecting the second end of the platform to the second end of the base;

a power unit in communication with the movement cylinder.

5. The apparatus according to claim 4 wherein the movement cylinder and the power unit further comprise hydraulics.

6. The apparatus according to claim 4 wherein the movement cylinder and the power unit further comprise pneumatics.

7. A baby comforting apparatus for a baby to lie upon, the apparatus comprising:

a 5-sided polygon having a top, a bottom, two spaced apart sides, and an end;

a parallelepiped platform comprising a part of the top, the platform having a first end, a second end, two spaced apart sides, a top, and a bottom;

means for cushioning the top of the platform;

a parallelepiped base having a first end, a second end, two spaced apart sides, a top, and a bottom;

a hinge connecting the first end of the platform to the first end of the base;

platform movement means for moving the second end of the platform relative to the base;

powering means in communication with the platform movement means;

whereby the rise and fall of a mother's breathing chest is simulated;

sound record/playback means for a person's heartbeat and breathing;

a switch in communication with the platform movement means, the record/playback means, and the powering means;

a pliable cover surrounding all but the bottom of the apparatus;

wherein the means for cushioning the top of the platform further comprises a cushion on the top the platform;

wherein the platform movement means for moving the second end of the platform relative to the base further comprises a movement cylinder connecting the second end of the platform to the second end of the base; and a power unit in communication with the movement cylinder.

8. The apparatus according to claim 7 wherein the movement cylinder and the power unit further comprise hydraulics.

9. The apparatus according to claim 7 wherein the movement cylinder and the power unit further comprise pneumatics.

* * * * *